US011444361B2

(12) United States Patent
Arnold et al.

(10) Patent No.: US 11,444,361 B2
(45) Date of Patent: Sep. 13, 2022

(54) ROTATABLE COAXIAL SWITCHING DEVICE INCLUDING ELECTRICAL CONNECTIONS CONFIGURED FOR PROVIDING CAPACITIVE COUPLING

(71) Applicant: Tesat-Spacecom GmbH & Co. KG, Backnang (DE)

(72) Inventors: Christian Arnold, Backnang (DE); Jean Parlebas, Backnang (DE); Matthias Herte, Backnang (DE)

(73) Assignee: Tesat-Spacecom GmbH & Co. KG

( * ) Notice: Subject to any disclaimer, the term of this patent is extended or adjusted under 35 U.S.C. 154(b) by 229 days.

(21) Appl. No.: 16/774,374

(22) Filed: Jan. 28, 2020

(65) Prior Publication Data

US 2020/0243938 A1 Jul. 30, 2020

(30) Foreign Application Priority Data

Jan. 30, 2019 (DE) ..... 10 2019 102 274.6
May 9, 2019 (DE) ..... 10 2019 112 169.8

(51) Int. Cl.

| | |
|---|---|
| ***H01P 1/12*** | (2006.01) |
| ***H01P 3/06*** | (2006.01) |
| ***H01R 9/05*** | (2006.01) |
| ***H01P 5/08*** | (2006.01) |
| ***H01P 7/06*** | (2006.01) |
| ***H01P 1/10*** | (2006.01) |

(52) U.S. Cl.

CPC ..... *H01P 1/125* (2013.01); *H01P 1/10* (2013.01); *H01P 3/06* (2013.01); *H01P 5/08* (2013.01); *H01P 7/06* (2013.01); *H01R 9/05* (2013.01)

(58) Field of Classification Search

CPC ..... H01P 1/125; H01P 1/10
USPC ..... 333/105
See application file for complete search history.

(56) References Cited

U.S. PATENT DOCUMENTS 3,064,212 A * 11/1962 Alford ..... H01P 5/04 333/107
3,530,504 A * 9/1970 Konishi ..... H01P 1/125 333/1
4,229,746 A 10/1980 Charlton
4,649,355 A 3/1987 Ullman
(Continued)

FOREIGN PATENT DOCUMENTS

DE 1916102 A1 10/1970
EP 0162334 A2 11/1985
(Continued)

OTHER PUBLICATIONS

Extended European Search Report including Written Opinion for EP20154364.2 dated Jun. 23, 2020; 17 pages.

*Primary Examiner* — Benny T Lee
(74) *Attorney, Agent, or Firm* — Lerner, David, Littenberg, Krumholz & Mentlik, LLP

(57) ABSTRACT

A switching device for connecting coaxial cables is specified. The switching device includes: a housing with at least two coaxial connectors; a switch rotor arranged in the housing such that it can be rotated about a longitudinal axis; and a first electrical connection, which passes through the switch rotor and in a predetermined position of the switch rotor capacitively couples a first coaxial connector and a second coaxial connector, thus creating an electrical connection between the first coaxial connector and the second coaxial connector.

12 Claims, 11 Drawing Sheets

(56) References Cited

U.S. PATENT DOCUMENTS

| | | | |
|---|---|---|---|
| 4,920,324 | A | 4/1990 | Whittaker et al. |
| 2017/0324133 | A1 | 11/2017 | Grassl et al. |

FOREIGN PATENT DOCUMENTS

| | | | |
|---|---|---|---|
| GB | 974323 | A | 11/1964 |
| JP | H0774502 | A | 3/1995 |
| SU | 81779 | A1 | 11/1948 |

* cited by examiner

ROTATABLE COAXIAL SWITCHING DEVICE INCLUDING ELECTRICAL CONNECTIONS CONFIGURED FOR PROVIDING CAPACITIVE COUPLING

FIELD OF THE INVENTION

The present invention relates in general to the technical field of high-frequency technology and relates in general to a switching device for connecting coaxial cables and to a switching arrangement with two or more of switching devices.

BACKGROUND OF THE INVENTION

In high-frequency technology, thus for the transmission and processing of signals with very high frequencies, such as signals well above 1 GHz and up to 35 to 40 GHz, waveguides or coaxial cables are usually used. These high frequency connections, for example, can be used as a component of satellite transmission links. The satellite radio transmission link can be, for example, a Ka-band transmission link in a frequency range of 17.7-21.2 GHz for the downlink and 27.5-31 GHz for the uplink, a Ku- or X-band implementation in the range around 11 or 7 GHz, or an L-band (around 1.5 GHz), S-band (around 2.5 GHz), or C-band implementation (around 4 GHz).

Sections of a waveguide connection are typically connected to connection pieces which are manufactured separately for the purpose. In order to establish a connection between two coaxial cables, plugs or switches are typically used, which create a galvanic contact between the coaxial cables to be connected.

It may be required to connect a plurality of coaxial cables to each in pairs selectively in a specific switching scheme. In order to achieve this, switching systems are used. This switching systems comprise connectors. In accordance with the requirements of the switching scheme, conductors are connected to the connectors in order to connect pairs of the connectors to each other.

BRIEF SUMMARY OF THE INVENTION

An aspect of the invention relates to a device which allows a flexibly adjustable, optional connection between coaxial connectors. Thus, a desired switching scheme can be set up or modified as required.

According to a first aspect, a switching device for connecting coaxial cables is specified. The switching device has a housing with at least two coaxial connectors, a switch rotor that can be rotated in the housing about a longitudinal axis, and a first electrical connection. The first electrical connection passes through the switch rotor and is designed in such a way that in a predetermined position of the switch rotor, the switch rotor capacitively couples a first coaxial connector and a second coaxial connector of the housing capacitive, thus forming an electrical connection between the first coaxial connector and the second coaxial connector.

The switching device is therefore designed to switch a signal applied to the first coaxial connector through to the second coaxial connector. The switching device can also have more than two coaxial connectors. In that case these coaxial connectors can in particular be connected in pairs, i.e., so that the switch rotor connects two coaxial connectors together in each case. Signals can be transmitted unidirectionally or bi-directionally via this connection. However, another possibility is that the switch rotor is designed in such a way that the switch rotor routes an input port (first coaxial connector) to two output ports (second and third coaxial connector), or vice versa.

The housing can be made from aluminum or an aluminum alloy, for example. The switching rotor can in principle also comprise or consist of the same material.

The switch rotor can essentially be designed as a cylinder and has a longitudinal axis. The switch rotor can be rotated about this longitudinal axis to be moved into different angular positions. The electrical connection passes through the switch rotor. The electrical connection has two ends. Each end is capacitively coupled to a coaxial connector (in particular within the housing) when the switch rotor is in the corresponding angular position. The switch rotor is located between the coaxial connectors and can be moved into a desired position to create an electrical connection. This can be described by comparison to a dial of an analogue clock. The coaxial connectors can be positioned at nine o'clock and three o'clock. The switch rotor can then be rotated between the coaxial connectors such that the ends of the electrical connection are located opposite the coaxial connectors, thus at nine and three o'clock also. In this position the two coaxial connectors are electrically connected to each other. If the switch rotor is turned further, for example, by 45°, 90°, 135° or another value other than 180°, the electrical connection between the two coaxial connectors is broken.

The coaxial connectors can be an integral part of the housing. The housing can be formed as a single piece or from two half-shells, or more generally a plurality of shells. In this case, the coaxial connectors can be manufactured integrally with one of the shells or half-shells.

For example, the electrical connection extends through the switch rotor in a straight line and perpendicular to a direction of the longitudinal axis. Coaxial connectors can thus be connected to each other which extend in the housing diagonally with respect to each other, are opposite each other (180° offset) or offset by 90° relative to each other (in the latter case, one connector is located at nine o'clock and another connector at six o'clock on the dial). The electrical connection thus passes through the switch rotor in such a way that in a certain position (in particular angular position) of the switch rotor an electrical connection is created between the positions of the coaxial connectors.

According to one embodiment, the switch rotor is provided with a slot. The first electrical connection extends along the slot, wherein the first electrical connection has an inner conductor, wherein, in the longitudinal direction thereof, the inner conductor is galvanically connected to the switch rotor, at least in some sections. The inner conductor in the slot is surrounded, at least in some sections, by an insulator and/or a dielectric (for example but not exclusively: polytetrafluoroethylene (PTFE), for example available under brand name TEFLON™).

The inner conductor is designed as a ridge or an elevation in the slot. In this embodiment, the inner conductor is galvanically connected to the switch rotor at least at one point or one position. Thus, the inner conductor can be electrically grounded.

The inner conductor is electrically conductive and designed to transmit the high frequency signal. The slot in the switch rotor can be referred to, for example, as a "recess" or "breakthrough" and in particular extends in a straight line and connects two positions on the outer surface of the switch rotor. In a through-connecting position of the switch rotor the two positions on the outer surface of the switch rotor are facing the coaxial connectors, so that in the through-connecting position of the switch rotor a capacitive coupling is created between a coaxial connection and an end of the electrical connection in each case.

The electrical connection within the switch rotor is designed similarly to a coaxial connection. One inner conductor is at least partially surrounded by an insulator and/or dielectric. The insulator or the dielectric are, in turn, surrounded by the material of the switch rotor (the inside wall of the slot surrounded by the switch rotor).

According to a further embodiment, the first electrical connection has a terminating element at each of its opposite ends in the longitudinal direction of the inner conductor. The terminating element is connected electrically or inductively to the inner conductor of the electrical connection which passes through the switch rotor, wherein the two terminating elements are each configured to be capacitively coupled to a coaxial connector in the predetermined position of the switching rotor (in the through-connecting position), and thereby to create the electrical connection between the first coaxial connector and the second coaxial connector.

The terminating element can be designed in the form of a plate. The terminating element preferably has a larger diameter than the inner conductor in order to enlarge the surface area for the capacitive coupling to the coaxial connector. The coaxial connector on the housing side also has an inner conductor, which is surrounded by an insulator or dielectric. A capacitive coupling occurs when the terminating element of the inner conductor of the electrical connection of the switch rotor is opposite the inner conductor (or a part thereof) of the coaxial connector on the housing side. The inner conductor and the terminating element are inductively connected to each other, or even designed as a single piece.

Preferably, the inner conductor of the coaxial connector also has a terminating element. This terminating element is designed similarly to the terminating element of the electrical connection of the switch rotor. The terminating elements on the switch rotor and on the housing can have identical dimensions, in particular the same diameter. In the through-connecting position of the switch rotor the terminating elements are located opposite one another, preferably with no horizontal or vertical offset. Between the terminating elements a small air gap is situated. The dimensions of the air gap, i.e. the distance between the terminating elements in the through-connecting position, can vary depending on the respective application (in particular, frequency of the transmitted signals, signal power, etc.). For example, the distance between the terminating elements in the through-connecting position can have a value of between a tenth of a millimetre and one or two millimetres.

According to a further embodiment the inner conductor extends between the two terminating elements, at least in some sections in a straight line.

According to a further embodiment, in combination or independently of the inner conductor which extends in a straight line at least in some sections, the terminating element has a plate-like design. Such a plate-like design can apply to the terminating element of the switch rotor and to the terminating element of the coaxial connector of the housing.

For example, the terminating element of the switch rotor can have a convex shape. This allows the switch rotor to be rotated together with the terminating element without the terminating element colliding with the wall of the housing. Conversely, the terminating element of the coaxial connector of the housing can be concave, so that the terminating elements are preferably an equal distance apart over their entire width and height when the switch rotor is in the through-connecting position.

According to a further embodiment, in combination or independently of the inner conductor extending at least in some sections in a straight line, and in combination or independently of the plate-shaped terminating element, the terminating element is inclined with respect to a longitudinal direction of the inner conductor.

The terminating element is preferably inclined in the horizontal direction. This can be advantageous if the electrical connection does not extends through the centre of the switch rotor, but is offset from the central axis of the switch rotor in the direction of the outer surface. In other words, the terminating element is inclined in order to align with or generally correspond to the outer surface of the switch rotor at the position of the electrical connection. The terminating element therefore also protrudes from the switch rotor by a lesser amount and the switching device overall can have a more compact and space-saving design.

According to a further embodiment, the inner conductor is electrically connected to the switch rotor over the entire length of at least one side face.

The inner conductor can be described as a body with two base surfaces and an outer surface. The base surfaces correspond to the opposite ends of the inner conductor in the longitudinal direction. The outer surface is electrically connected at one point and additionally either thermally and/or mechanically connected to the switch rotor, specifically along the entire length of the inner conductor. The outer surface can consist of one or more side faces corresponding to the shape of the base surface. For triangular base surfaces, the outer surface of the inner conductor has three side faces, for rectangular base surfaces there are four side faces, etc. One of these side faces in this embodiment is electrically and, additionally either mechanically and/or thermally, connected to the switch rotor.

Therefore, along the longitudinal direction of the inner conductor between the inner conductor and the switch rotor along at least one side face (for example, opposite the side face galvanically connected to the switch rotor), a gap is formed, within which a high-frequency signal can propagate in the longitudinal direction of the inner conductor.

According to a further embodiment the inner conductor is designed integrally with at least one component of the switch rotor or is mechanically coupled to the switch rotor.

The switch rotor can consist of one or more components. The inner conductor is coupled to at least one of these components, either by means of a mechanical connection (e.g.: screwed, clamped, riveted) or because the component and the inner conductor are designed as a single piece. In this embodiment, a mechanical and thermal connection is created between the inner conductor and the switch rotor. Furthermore, the inner conductor is held at the intended position very reliably. The inner conductor is not completely surrounded by dielectric, but only where the inner conductor is not in contact with the switch rotor or is joined to it (in the event that inner conductor and switch rotor are integral).

According to a further embodiment, a second electrical connection which is spaced apart from the first electrical connection extends in the switch rotor.

The second electrical connection can be positioned and oriented in such a way that in one position of the switch rotor electrical connections are created between two different pairs of coaxial connectors. For example, the first electrical connection can connect a first and a second coaxial connector together and the second electrical connection can connect a third and a fourth coaxial connector together.

According to a further embodiment the second electrical connection is offset with respect to the first electrical connection in a direction along the longitudinal axis of the switch rotor.

Thus, the pairs of coaxial connectors which are each connected together by means of the first and second electrical connection are also offset with respect to each other in the same direction.

Alternatively, it is possible that the respective pairs of coaxial connectors to be connected are arranged in the longitudinal direction of the switching rotor at the same height. The coaxial connectors are then located at different positions along the circumferential direction of the switch rotor. For example, four coaxial connectors can be arranged at 12 o'clock, 3 o'clock, 6 o'clock and 9 o'clock. The switch rotor with the two electrical connectors can be rotated into a position such that an electrical connection is made between two of these coaxial connectors in each case.

According to a further embodiment the second electrical connection extends at an angle between 0° and 90° with respect to the first electrical connection.

According to a further embodiment, each coaxial connector of the switching device has a coaxial post. The coaxial post is inductively coupled to an electrical conductor of the respective coaxial connector.

The coaxial post can have a positive effect on the high frequency transmission properties in the switching device, in particular between the electrical connection of the switch rotor and/or the terminating element and a coaxial connector.

The coaxial post is inductively coupled to the inner conductor of the coaxial connector. The housing can form a cavity in conjunction with the switch rotor, in which the coaxial post is arranged. The cavity can be provided, for example, as an indentation in the outer surface of the switch rotor.

According to a further embodiment the first electrical connection of the switch rotor capacitively couples to the coaxial posts of the coupled coaxial connectors in the predetermined position of the switch rotor. At one end of the coaxial post, for reasons associated with high-frequency transmission characteristics, a capacitive load can be arranged.

According to a further embodiment at least two radial indentations are arranged on the switch rotor, within each of which a terminating element of the first electrical connection is located.

The terminating element therefore does not protrude, or not substantially, beyond the periphery of the switch rotor. Thus, the switch rotor can be rotated within the housing into a desired angular position without protruding or prominent elements from the switch rotor requiring a greater distance between the switch rotor and housing.

The indentation in the switch rotor can also form the above-mentioned cavity or be part of the cavity.

In accordance with a further embodiment the switching device additionally comprises a drive. The drive is connected to the switch rotor such that the drive can move the switch rotor around the longitudinal axis into different predetermined positions by means of a rotational movement.

The drive can be an electro-mechanical powered machine, for example, an electrically driven motor. The motor can, in particular, be arranged and controlled in such a way that an angular position of the switch rotor with respect to the housing is passed to a motor controller and the motor controller then controls the motor such that the switch rotor turns from the current position into the desired position.

According to a further aspect a switching arrangement for selectively connecting a plurality of coaxial cables in pairs is specified. The switching arrangement has a first switching device as described above and in the following and a second switching device as described above and in the following, wherein the first switching device is coupled to the second switching device directly (i.e., for example without having to use another conductor or cable section) using a coaxial connector.

The switching devices of the switching arrangement can be arranged in a common housing. The connection between the two switching devices is integrated into the switching arrangement. Thus, no separate external connection cable is needed for this connection. This enables a compact and space-saving design and reduces the number of separate parts required.

According to one embodiment, at a coupling point between the first switching device and the second switching device a single coaxial post is arranged, so that an electrical connection between the first and second switching device is made via a capacitive coupling of the respective electrical connections of the switching devices via the single coaxial post.

The coaxial post thus represents the link between two electrical connections of the switch rotors in the adjacent switching devices.

It is of course possible to connect an arbitrary number of switching devices directly to each other, and not only electrically but also mechanically. The switch rotors of the individual switching devices can then each be placed in such a position that a signal from a first switching device is routed through the switch rotor of a second switching device to a desired coaxial connector of the second switching device, where the signal is then used for further processing. It is conceivable to provide a two-dimensional array of switching devices connected to each other in a cascade. A plurality of switching devices (at least two) can be connected to each other in a row. A plurality of such rows (at least two) can then be connected to each other in turn. This design can also be referred to as a switching matrix.

Further embodiments of the switching device are described with reference to the following drawings.

BRIEF DESCRIPTION OF THE DRAWINGS

In the following, exemplary embodiments of the invention will be discussed in detail based on the attached drawings. The drawings are schematic and not drawn to scale. Identical reference numerals refer to identical or similar elements. Shown are.

DETAILED DESCRIPTION OF THE INVENTION

FIGS. 1A-1D show the basic principle of a switching device based on different switch positions, in which different connectors (ports) are electrically connected to each other.

Figure 1A:
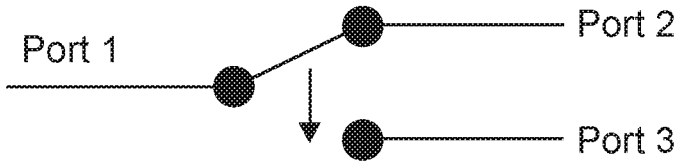
FIGS. 1A-1D are schematic drawings of switching states of a switching device in accordance with one exemplary embodiment.
Figure 1B:
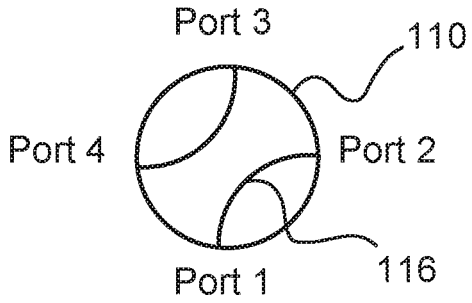
Figure 1C:
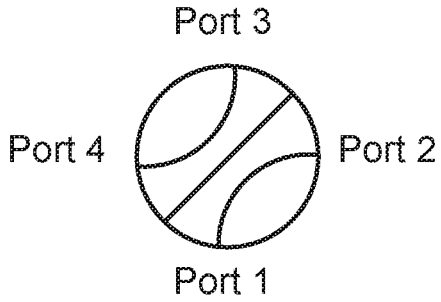
Figure 1D:
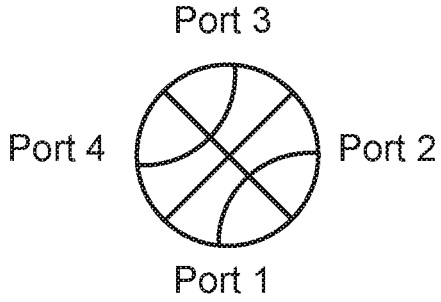

The first schematic diagram (FIG. 1A) shows a simple toggle switch mechanism, in which port 1 can be connected either to port 2 or port 3. The diagrams FIGS. 1B, 1C, 1D show a switch rotor 110 (FIG. 1B), which in each case is arranged between one of four ports (port 1, port 2, port 3, port 4). The ports are matched to the coaxial connectors (for example, 50-Ohm cables). Any two of the four ports can be electrically connected to each other, which means that the ports are connected to each other in pairs. The electrical connections 116 (FIG. 1B) are arranged within the switch rotor 110.

It should be noted that the electrical connections and their paths are shown schematically in FIGS. 1A-1D. The mere fact that the connections are shown here as curved or circular arc-shaped does not mean that the electrical connections within the switch rotor are actually arc-shaped.

Diagram FIG. 1B shows a switch rotor with two electrical connections, which each connect adjacent ports. As shown, port 1 is connected to port 2 and port 3 to port 4. If the switch rotor is turned clockwise or counter-clockwise by 90°, a connection is created between port 1 and port 4 and between port 2 and port 3. If the switch rotor is turned from the position shown by 45°, no port is connected to another.

Diagram FIG. 1C extends the switch rotor 110 from diagram FIG. 1B to include a third electrical connection, which is located between the electrical connections from diagram FIG. 1B. This third electrical connection connects two opposite ports to each other when the switch rotor is turned by 45° from the position shown. In the switching state then reached, the two connections shown in diagram FIG. 1B are not coupled to a coaxial connector.

Diagram FIG. 1D extends the switch rotor from diagram FIG. 1B to include an additional electrical connection (fourth electrical connection). The fourth electrical connection crosses over the third electrical connection. The fourth electrical connection also connects diametrically opposite coaxial connectors, in fact the two connectors which are not connected to each other by the third electrical connection. If the switch rotor in diagram FIG. 1D is rotated by 45° (not shown), port 1 is connected to port 3 and port 2 is connected to port 4.

A switching device designed in such a way with coaxial connectors enables the switching device to switch a broadband connection up to very high frequencies of 30 GHz or more and is characterized by low losses. Coaxial connectors can be integrated directly on or into the switching device. The switching device for coaxial cables has a compact and space-saving design and is suitable for medium power levels at low frequencies (for example, 100 to 150 Watts in the L, S, or C band) and low powers at low and high frequencies (for example, 1 Watt in the L, S, C, X, Ku, Ka, Q band).

Figure 2A:
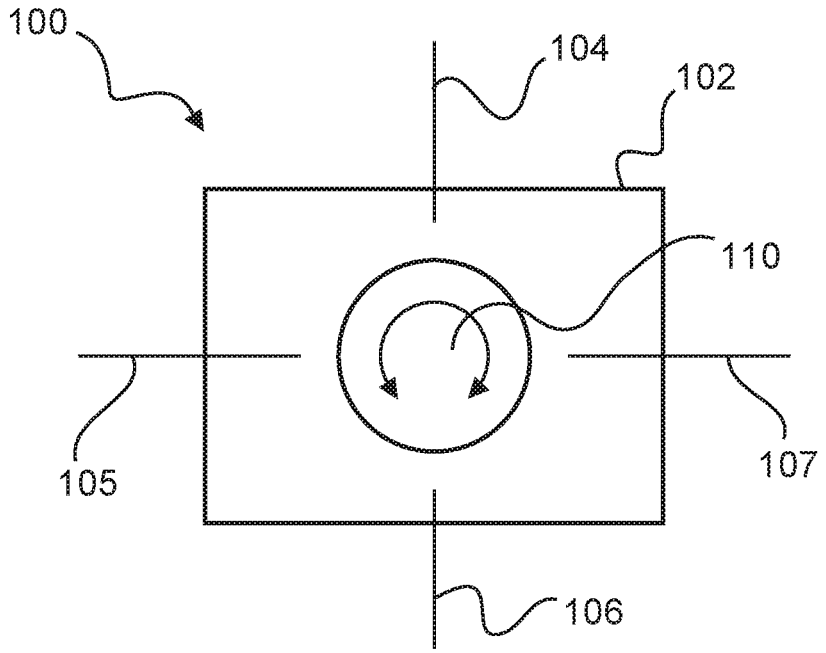
FIGS. 2A and 2B are schematic drawings of a switching device in accordance with one exemplary embodiment in plan view and in a sectional front elevation.
Figure 2B:
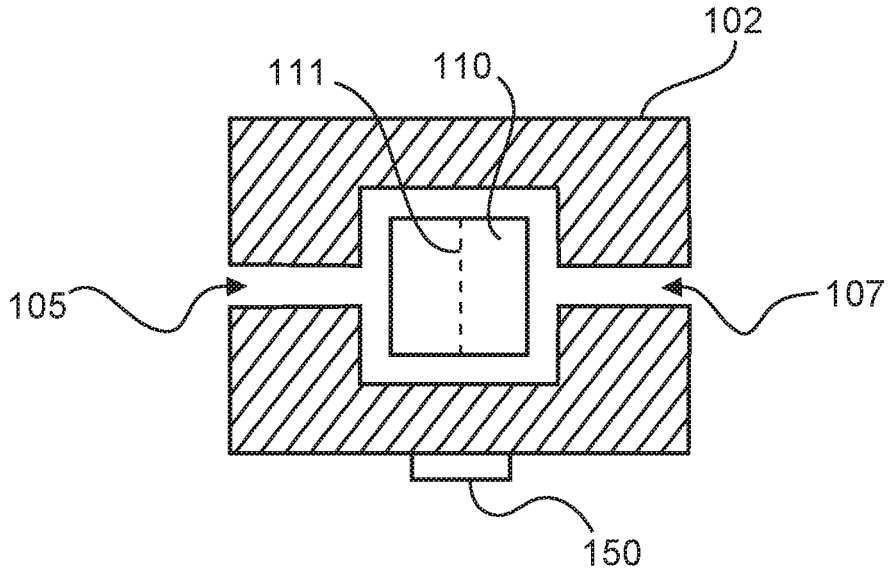

FIGS. 2A, 2B show the basic structure of a switching device 100 (FIG. 2A) comprising the housing 102, coaxial ports 104 (FIG. 2A), 105, 106, 107 and switch rotor 110.

FIG. 2A is a plan view of the switching device. The switch rotor 110 can be a cylinder (circular in plan view). The switch rotor can be rotated about its longitudinal axis in both directions, as shown by an arrow. By this rotation the switch rotor 110 changes its angular position and also its position relative to the coaxial ports, which are arranged opposite the outer surface of the switching rotor. The coaxial connectors are arranged on the housing 102.

FIG. 2B is a cross-sectional view of the switching device from the front. In the switch rotor 110 the longitudinal axis 111 is shown. The housing has an opening on the left and right for the coaxial ports 105, 107.

On the housing 102 (FIG. 2A) a drive 150 is arranged, which is connected to the switch rotor 110 such that the drive can set the switch rotor into rotation about the longitudinal axis 111 and move it into a desired angular position relative to the coaxial ports. The drive can be an electric motor, which is supplied with electrical energy (energy source and supply cables are not shown).

Figure 3:
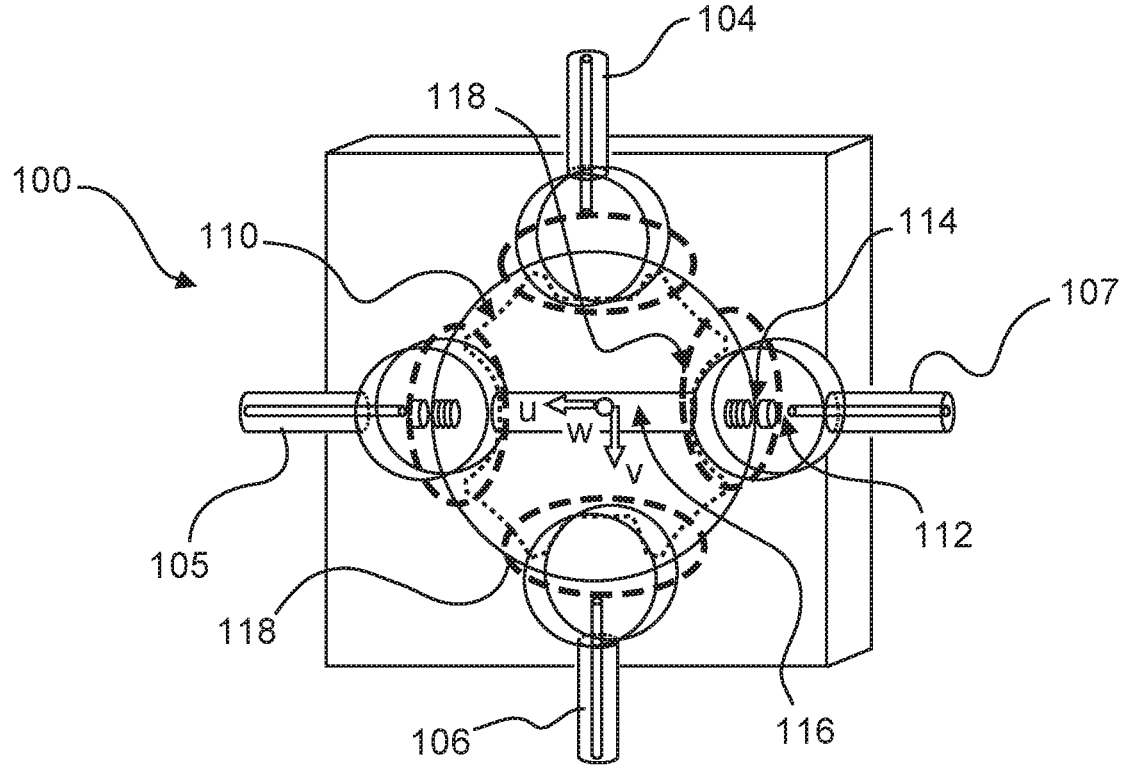
FIG. 3 a schematic drawing of a switching device in accordance with one exemplary embodiment.

FIG. 3 shows a schematic isometric drawing of a switching device. Four coaxial ports 104, 105, 106, 107 emanate from the housing. The switch rotor 110 is located in the housing. An electrical connection 116 is arranged within the switch rotor 110. The electrical connection 116 couples, depending on the position of the switch rotor 110, two opposite coaxial ports 105, 107 (as shown in FIG. 3) or 104, 106 (if the switch rotor is rotated by 90° from FIG. 3).

The cross-sectional shape of the switch rotor 110 in FIG. 3 is not cylindrical, because the switch rotor has four indentations. Two of these indentations are located at the ends of the electrical connection 116. Thus, a cavity 118 is formed within which the electrical connection 116 is capacitively coupled to a coaxial connector 105, 107. The cavity can also be referred to as a resonator. In the cavity, a coaxial post 114 is arranged, which is inductively coupled to the inner conductor of the coaxial connector. At this point, therefore, an inductive input coupling 112 exists.

In FIG. 3, the longitudinal axis of the switch rotor extends in the drawing plane. The axis u extends horizontally in the plane of the drawing, the axis v extends vertically in the plane of the drawing and the axis w extends perpendicular to the plane of the drawing. The switch rotor in this diagram is therefore rotated in a clockwise or counter-clockwise direction. The drive is used for this purpose (see FIG. 2). It is conceivable that the switch rotor can also be manually rotated. This is practical if an initial configuration of the switching device needs to be flexibly set, but does not need to be changed during the operating period.

Figure 4:
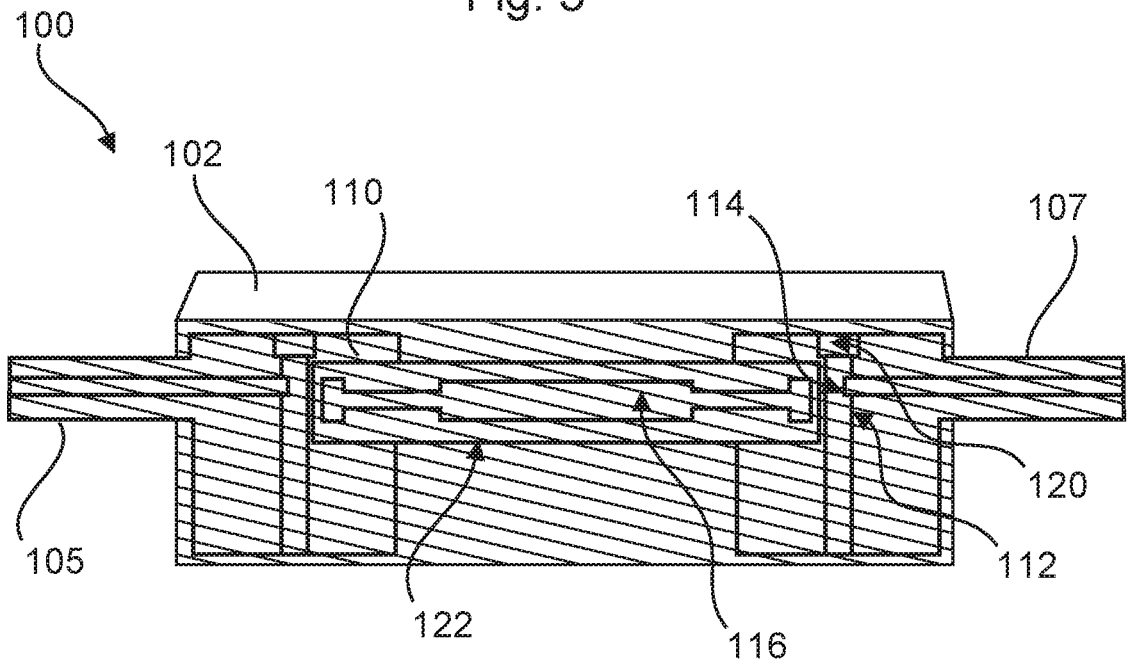
FIG. 4 a schematic sectional view of a switching device in accordance with one exemplary embodiment.

FIG. 4 shows a cross-sectional view of the front elevation of the switching device, comparable to FIG. 2B.

The coaxial ports 105, 107 extend into the housing 102 and open into a cavity. In this cavity, a coaxial post 114 is located, which is inductively coupled to the inner conductor of the corresponding coaxial connector. At one end of the coaxial post a capacitive load 120 is arranged. The switch rotor 110 is arranged between the coaxial ports 105, 107. An electrical connection 116 extends in the switch rotor, which capacitively couples the two coaxial ports depending on the angular position of the switch rotor. At the top and bottom of the switch rotor an air gap 122 can be arranged, so that the switch rotor can be rotated in the housing.

Figure 16:
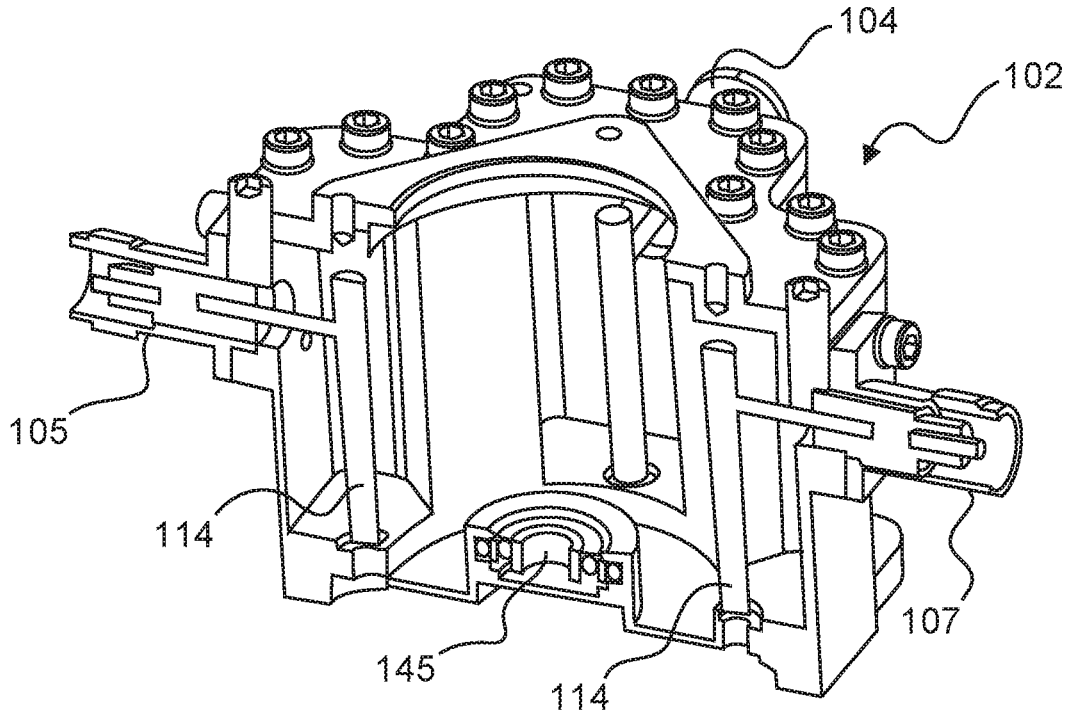
FIG. 16 a schematic drawing of a housing of a switching device in accordance with one exemplary embodiment.

The switch rotor can also be held in the housing by means of a bearing, see FIG. 16.

Figure 5:
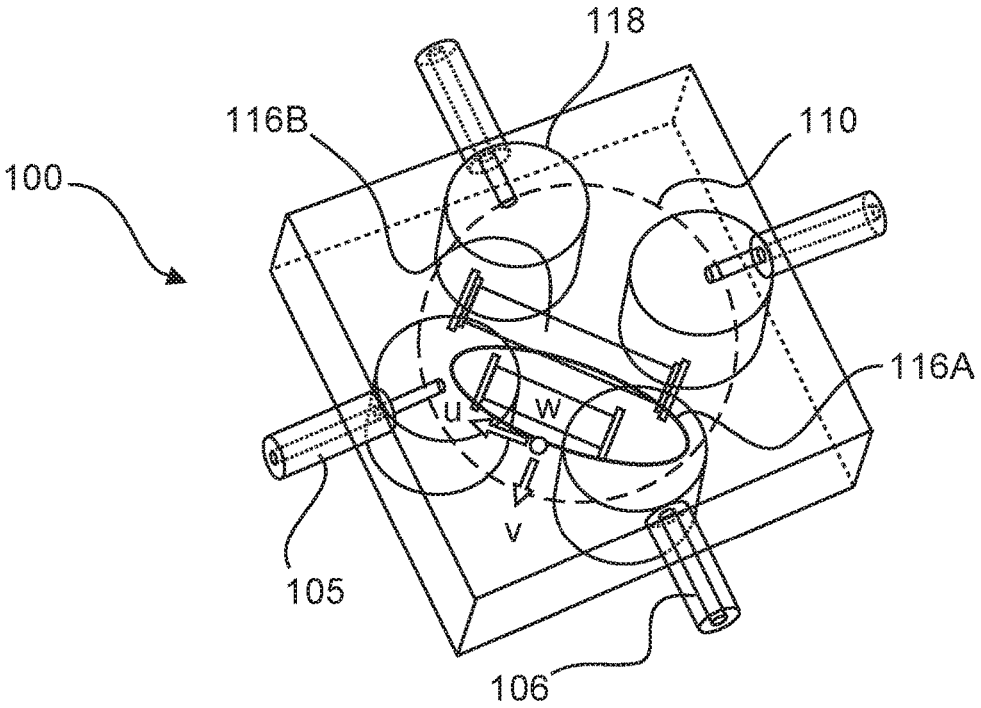
FIG. 5 a schematic drawing of a switching device in accordance with one exemplary embodiment.

FIG. 5 shows an isometric schematic drawing of a switching device 100. In the switch rotor 110 two electrical connections are arranged. In the position of the switching rotor 110 shown, the electrical connection 116A connects the coaxial ports 105 and 106 to each other. It is apparent that the electrical connection 116A extends in a straight line within the switch rotor and is arranged eccentrically with respect to a longitudinal central axis of the switch rotor.

The switch rotor also contains another electrical connection 116B. This extends through the central axis of the switch rotor and is arranged to connect opposite coaxial ports to each other. For this purpose, the switch rotor 110 must be turned by 45° from the position shown, however.

The electrical connections 116A, 116B (first and second electrical connection) are laterally offset relative to each other in the plan view. These connections can also be offset relative to each other along the longitudinal axis of the switch rotor. Even if an electrical connection along the longitudinal axis of the switch rotor is offset with respect to a second electrical connection, these electrical connections can nevertheless capacitively couple to the same coaxial connectors at the appropriate angular positions of the switch rotor if the coaxial post has a corresponding longitudinal extension.

Figure 6:
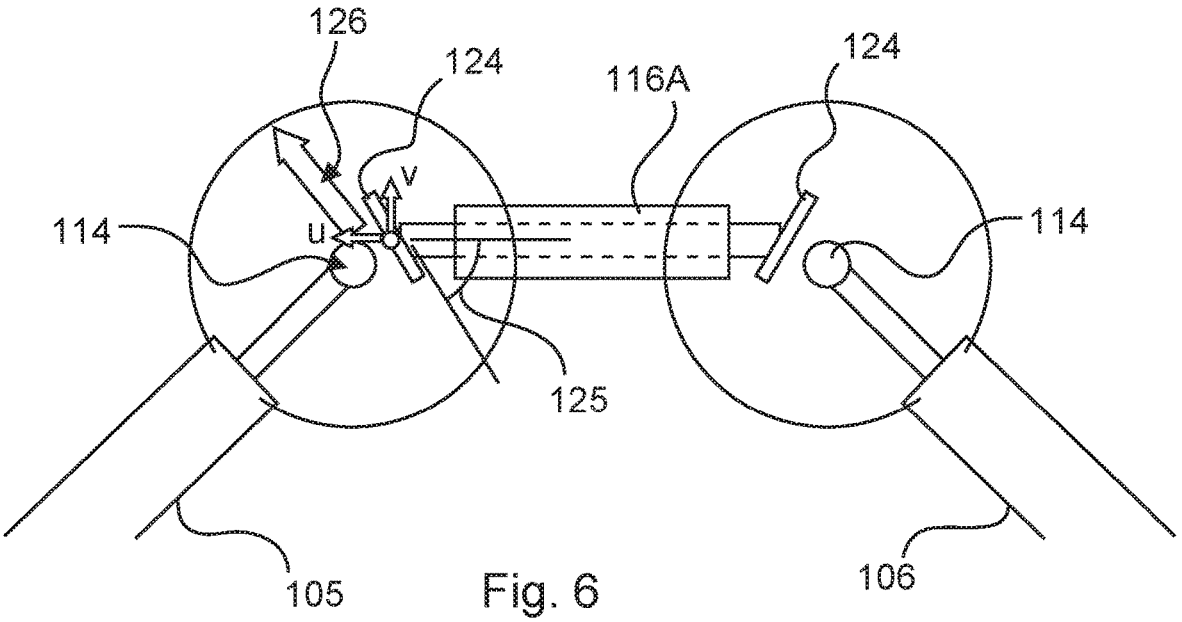
FIG. 6 a schematic drawing of a part of a switching device in accordance with one exemplary embodiment.

FIG. 6 shows an enlarged view of a variant of the electrical connection 116A from FIG. 5. Two coaxial ports 105, 106 are shown with the assigned coaxial post 114. The terminating elements 124 are inclined with respect to the longitudinal direction of the electrical connection 116A at an angle 125. If the switch rotor 110 is rotated in the rotation direction 126, the terminating element 124 touches the coaxial post 114. A (contactless) capacitive coupling persists at this point during all positions of the switch rotor. In this example the angle of inclination 125 is 45°. Depending on the position and orientation of the electrical connection, the angle of inclination can also assume other values.

Figure 7:
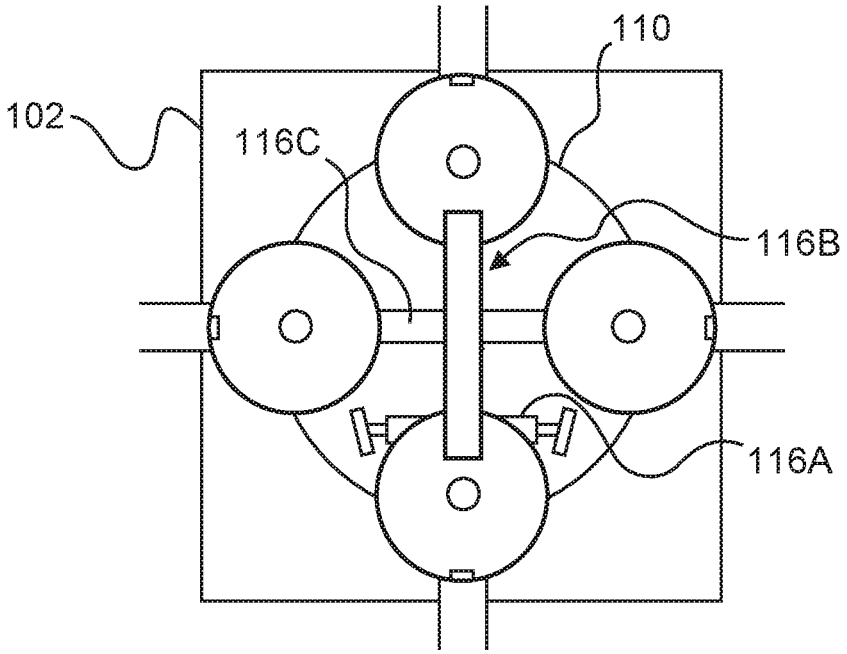
FIG. 7 a schematic drawing of a switching device in accordance with one exemplary embodiment.

FIG. 7 shows a diagram of the switching device in which the electrical connection 116B connects two opposite coaxial ports. The electrical connection 116A, on the other hand, is not coupled to any coaxial ports. A third electrical connection 116C extends perpendicular to the electrical connection 116B in the plan view of FIG. 7 and couples the other two opposite coaxial ports.

Figure 8:
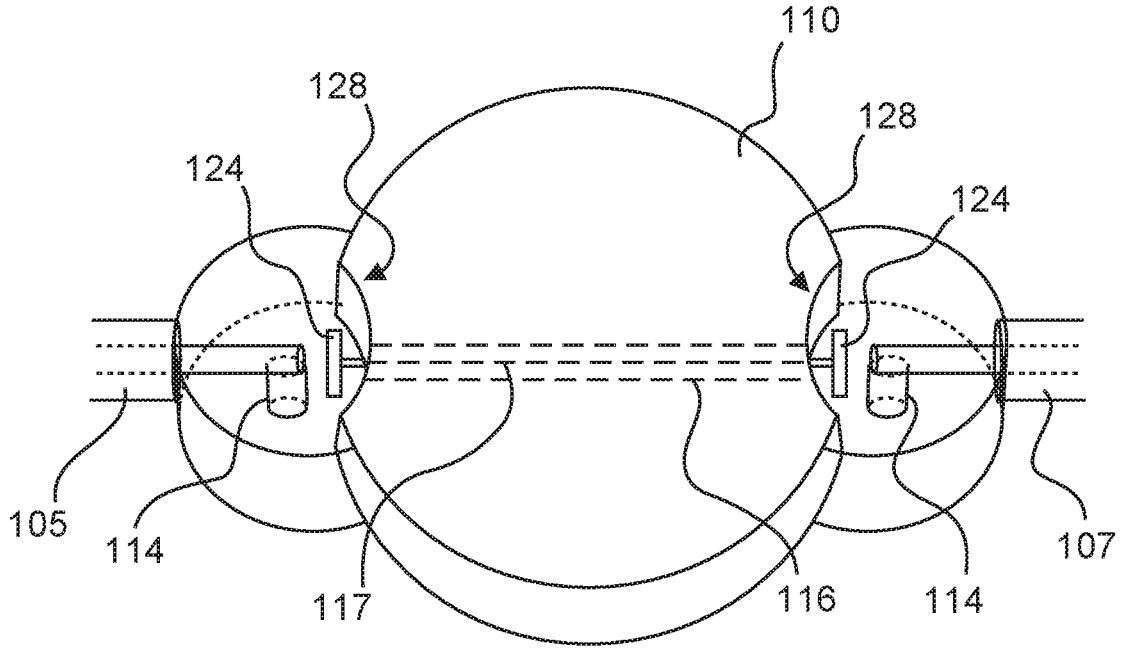
FIG. 8 a schematic drawing of a switching device in accordance with one exemplary embodiment.

FIG. 8 shows a switch rotor 110 having an electrical connection 116 and an associated inner conductor 117 and terminating elements 124 connected thereto. The terminating elements 124 are arranged within a radial indentation 128 in the outer surface of the switch rotor (circular arc-shaped concave recess). The indentation forms a cavity, which functionally resembles a resonator. The terminating elements 124 create a capacitive coupling to the associated coaxial post 114. The indentation 128 can be circular arc-shaped (as shown in FIG. 8) or have a different shape, such as elliptical, rectangular or triangular, wherein in the case of a triangular shape, the apex of the triangle points in the direction of the central axis of the switch rotor.

Figure 9:
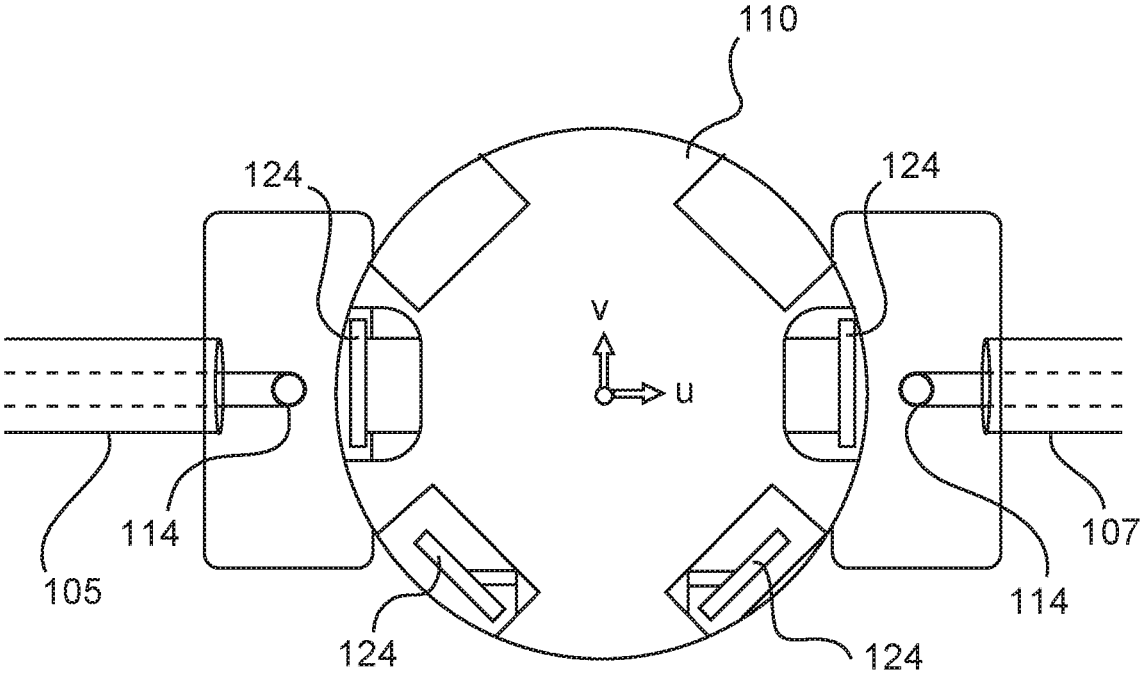
FIG. 9 a schematic drawing of a switching device in accordance with one exemplary embodiment.

FIG. 9 shows a switch rotor 110 with two electrical connections. The terminating elements 124 of the upper electrical connection are capacitively coupled to the coaxial ports 105, 107. The terminating elements 124 of the lower electrical connections have no function in the switching position shown. In FIG. 9 the radial indentations have a rectangular cross-section. Some of the radial indentations have rounded corners, while other radial indentations, on the other hand, have no rounded corners.

Figure 10:
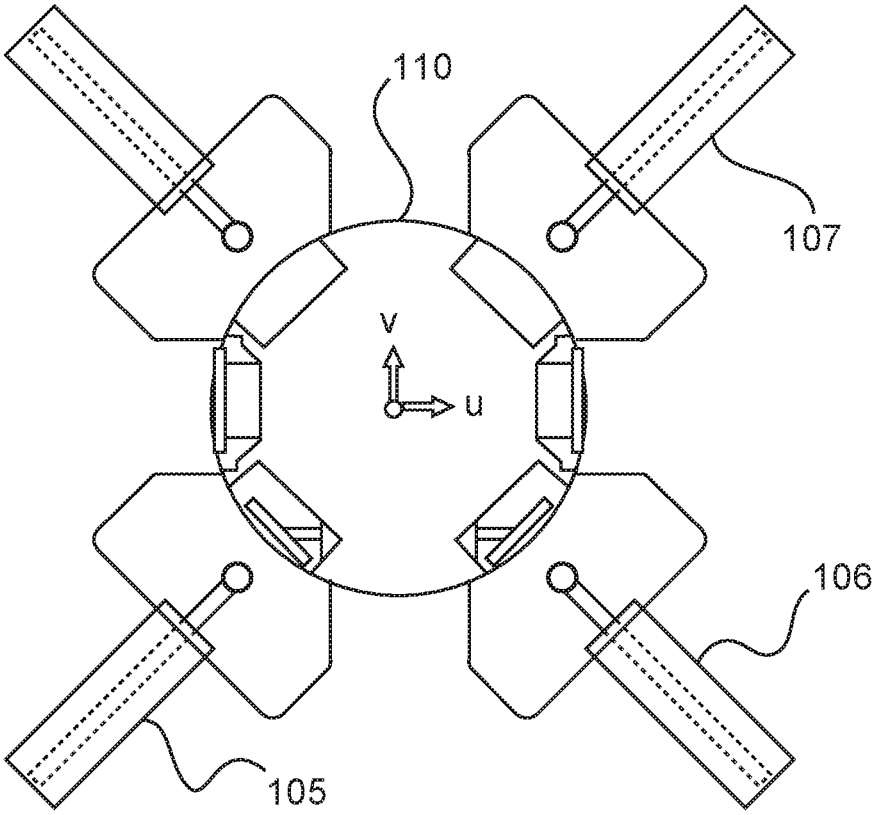
FIG. 10 a schematic drawing of a switching device in accordance with one exemplary embodiment.

FIG. 10 shows the switch rotor of FIG. 9 in a position rotated by 45° compared to FIG. 9. In FIG. 9 coaxial ports 105, 107 located opposite each other are connected to each other. In FIG. 10 the shorter electrical connection connects the adjacent coaxial ports 105, 106 at right angles.

Figure 11:
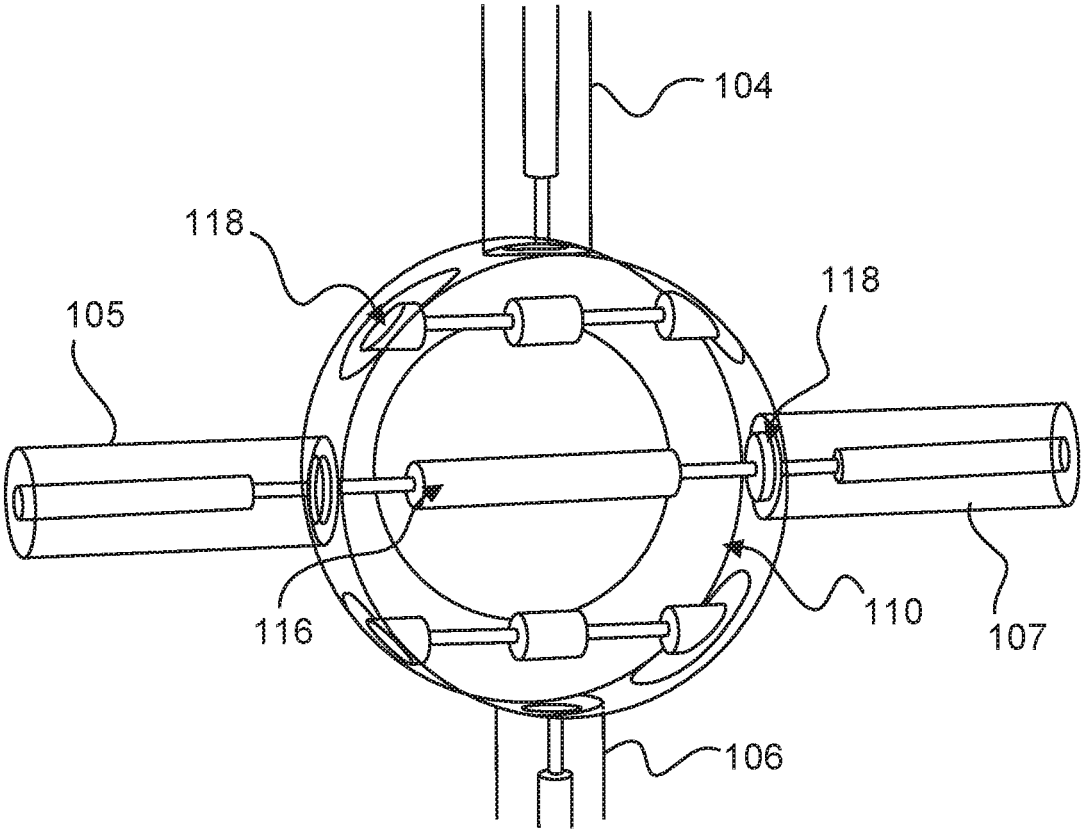
FIG. 11 a schematic drawing of a switching device in accordance with one exemplary embodiment.

FIG. 11 shows a switching device with three electrical connections, which are located next to each other in the radial direction of the switch rotor. These connections can also be offset relative to each other in the direction of the longitudinal axis of the switch rotor, however. Depending on the position of the switch rotor, different coaxial ports are connected to each other by means of capacitive coupling 118. In the position shown the coaxial ports 105, 107 are connected to each other. In the case of a rotation clockwise by 45°, the ports 104 and 107 on the one hand, and 105 and 106 on the other hand, are electrically connected to each other.

Figure 12:
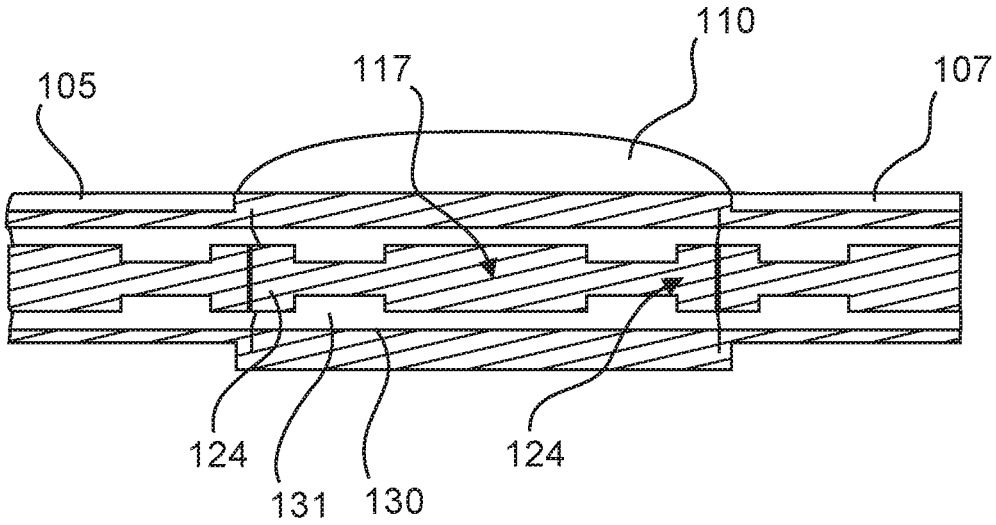
FIG. 12 a schematic sectional view of a switching device in accordance with one exemplary embodiment.

FIG. 12 shows a cross-sectional drawing of a side view of the switching device. Between the terminating elements 124, which are inductively coupled to the inner conductor 117 of the electrical connection, and the coaxial ports 105, 107 a capacitive coupling is created to transmit high-frequency signals. In FIG. 12 the slot 130 in the switch rotor for the electrical connection is easily identified. This slot extends transverse to the longitudinal axis and can be drilled or milled, for example. In the slot an insulator or dielectric 131 and the inner conductor 117 are arranged.

Figure 13:
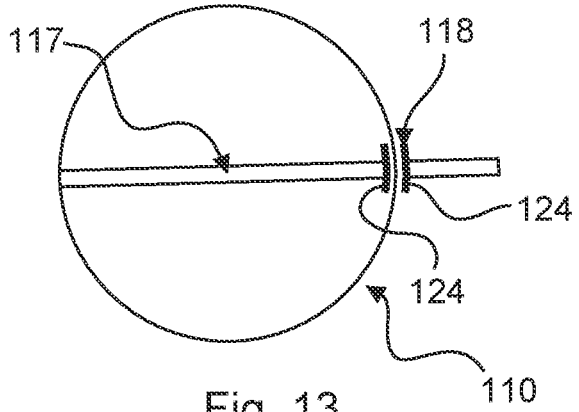
FIG. 13 a schematic drawing of a switching device in accordance with one exemplary embodiment.

FIG. 13 shows a schematic illustration of a switch rotor 110. An inner conductor 117 of an electrical connection extends through the switch rotor. At one end of the inner conductor 117 a terminating element 124 is arranged. At the other end of the inner conductor 117 an identical terminating element (not shown) can be arranged.

The terminating element 124 of the inner conductor in this example is shown rounded or circular. In the same way a terminating element 124 can be arranged on the inner conductor of the coaxial connector, wherein this terminating element is correspondingly curved.

Figure 14:
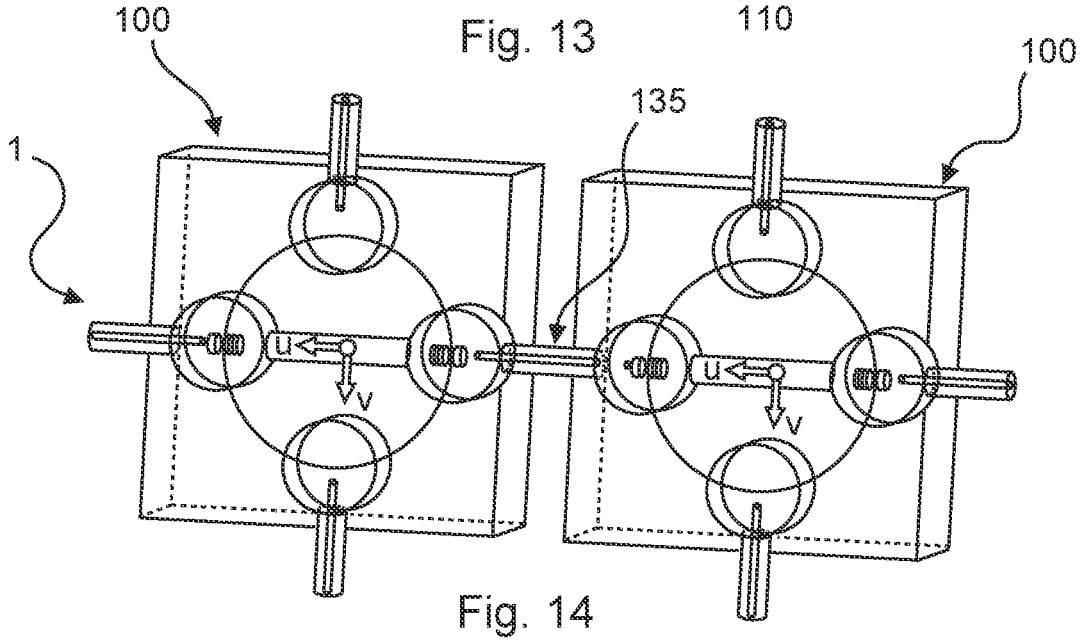
FIG. 14 a schematic drawing of a switching arrangement in accordance with one exemplary embodiment.

FIG. 14 shows a switching arrangement 1 consisting of two switching devices 100 as shown in any of the above exemplary embodiments. The two switching devices 100 are connected to each other at a coaxial connector 135. This coaxial connector 135 is electrically connected, preferably inductively, to a coaxial port of each of the housings of the two switching devices.

Figure 15:
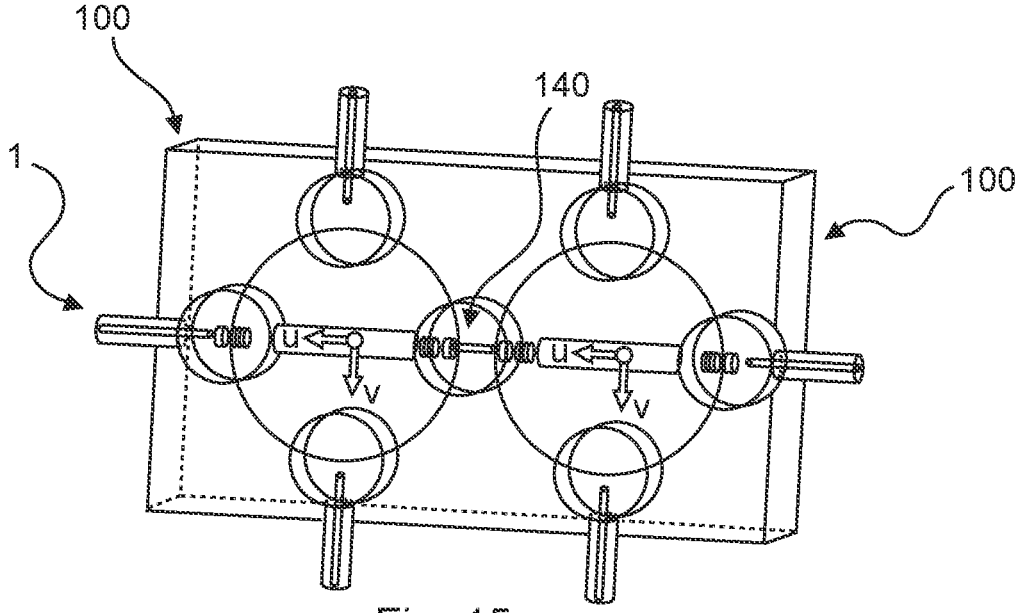
FIG. 15 a schematic drawing of a switching arrangement in accordance with one exemplary embodiment.

FIG. 15 shows an alternative design of the switching arrangement 1. The two switching devices 100 share a common capacitive coupling 140. Between the terminating elements, facing each other, of the inner conductors of the two switching devices a single coaxial post is arranged. At these positions the switch rotors can each form a cavity.

FIG. 16 shows a housing 102 of a switching device. The coaxial ports 104, 105, 107 are located on the housing. The housing can consist of two half-shells, wherein the half-shell facing the observer has been removed. A coaxial post which extends in the longitudinal direction of the switch rotor is arranged on each of the inner conductors of the coaxial ports 105, 107. A capacitive coupling between the inner conductor of the switch rotor and the coaxial post can be effected at any position in the longitudinal direction of the coaxial post. Thus, inner conductors can be arranged at different heights in the switch rotor (in the longitudinal direction).

A bearing 145, which holds the switch rotor, is arranged in the housing. The bearing can be connected to the drive 150 (see FIG. 2B) to turn the switch rotor.

Figure 17:
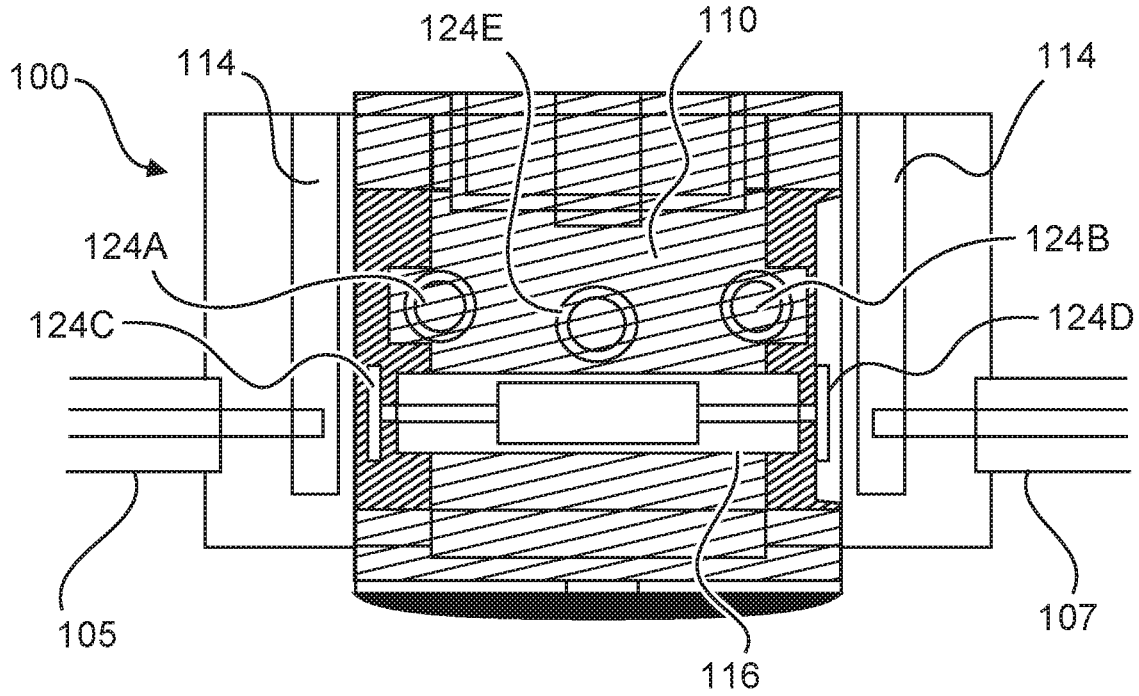
FIG. 17 a schematic drawing of a switching device in accordance with one exemplary embodiment.

FIG. 17 shows a schematic representation of a switching device 100 with a switch rotor having a plurality of electrical connections. The switch rotor is located in such a position that an electrical connection to the terminating elements 124C, 124D connects the coaxial ports 105 and 107 together. The frontal terminating element 124E of a further electrical connection can be seen, which is located centrally on the switch rotor. This electrical connection extends into the drawing plane. In addition, there is another electrical connection to the terminating elements 124A and 124B, which is similar to the connection 116A of FIG. 5 and FIG. 6.

Figure 18:
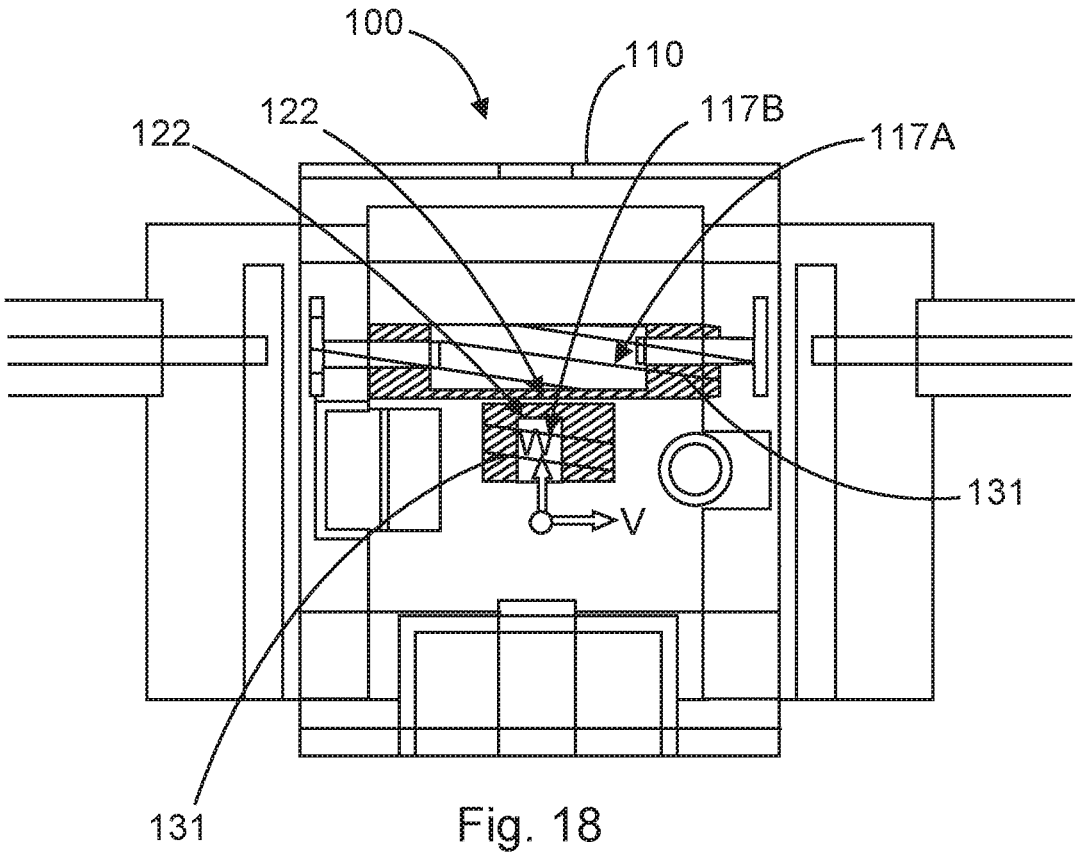
FIG. 18 a schematic drawing of a switching device in accordance with one exemplary embodiment.

FIG. 18 is a schematic representation of a switch rotor 110 with two electrical connections, one of which extends from left to right in the drawings, and the other extends into the drawing plane. In terms of the basic structure, the diagram in FIG. 18 corresponds to the structure already shown in FIGS. 11, 12 and 17, among others. Aspects described there are not repeated here but are nevertheless valid for this example.

From FIG. 18 it can be discerned that the inner conductor 117A in the electrical connection extending from left to right is electrically coupled to the switch rotor 110, specifically at the upper end of the slot in the switch rotor which is filled with dielectric 131. The inner conductor 117A rests with the upper side face thereof against the switch rotor, so that the inner conductor 117A is galvanically coupled to the switch rotor. In addition, the inner conductor 117A can also be mechanically and thermally coupled to the switch rotor. It is conceivable that the inner conductor is electrically coupled to the switch rotor at certain points, for example by means of spot welding or soldering, or by means of mechanical connecting elements, such as screws, bolts, rivets or the like. If the inner conductor is connected to the switch rotor by means of mechanical connecting elements, the inner conductor can be spaced apart from the switch rotor on all the side faces thereof. The version shown in FIG. 18, however, provides that one side face of the inner conductor is connected over the entire length thereof electrically, and optionally mechanically and/or thermally, to the switch rotor. The high-frequency signal propagates in the longitudinal direction of the inner conductor 117A in the gap 122.

The electrical connection to the inner conductor 117B extending into the drawing plane is similar in design to the electrical connection to the inner conductor 117A. However, the inner conductor 117B is arranged on the lower face of the corresponding slot in the switch rotor. This increases the distance between the inner conductors 117A and 117B. The inner conductors 117A and 117B extend at an angle of 90° relative to each other. It is possible for the inner conductors to be arranged or to extend at a different angle relative to each other.

The structure according to FIG. 18 has the advantage that the inner conductor is mechanically held in place in the slot. In addition, the inner conductors can be electrically grounded, because is the inner conductors are electrically connected to the switch rotor. In addition, a thermal connection can allow thermal energy to be conducted or dissipated from the inner conductor to the switch rotor. The dielectric 131 surrounds the inner conductor 117A, 117B on the side faces that are not in contact with the switch rotor. The dielectric 131 preferably fills the entire gap or the entire slot in the switch rotor.

Figure 19:
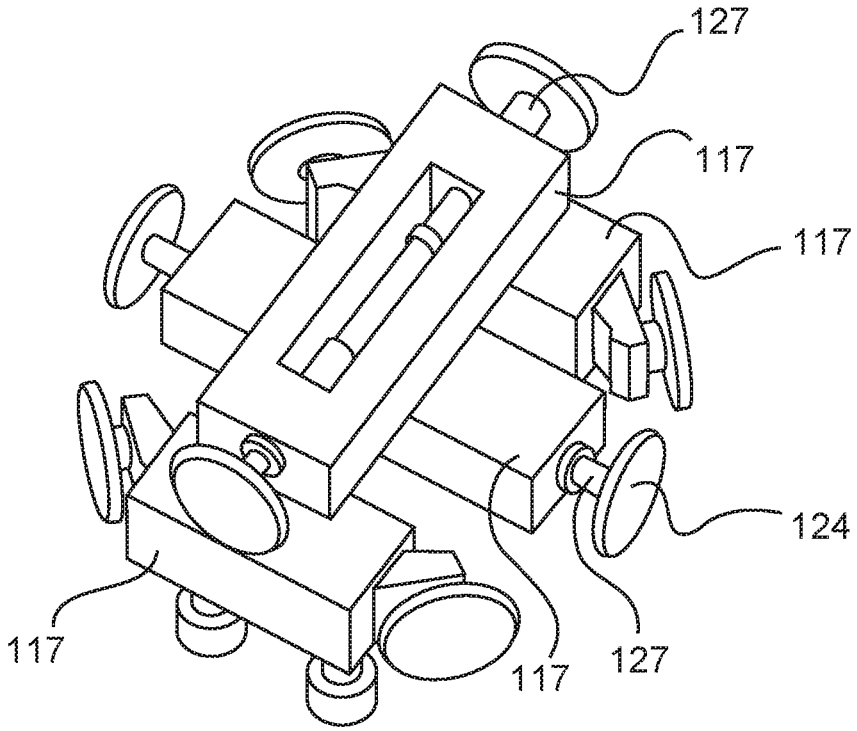
FIG. 19 a schematic drawing of a plurality of inner conductors in accordance with one exemplary embodiment.

FIG. 19 shows an isolated view of internal conductors 117 and their relative position to each other. For the sake of clarity, the switch rotor is omitted here.

In the foreground an inner conductor extends from the bottom left to the top right. In the background three inner conductors extend next to each other and perpendicular to the inner conductor in the foreground. As described above, these inner conductors can be connected electrically and/or mechanically and/or thermally to the body of the switch rotor. The terminating elements 124 are connected to the inner conductor 117 by means of a connecting piece 127. The connecting piece 127 can be, for example, screwed, plugged in, or clamped into the inner conductor. The connecting piece is preferably surrounded by dielectric in the assembled state and is not directly in contact with the switch rotor, see, for example, FIG. 18.

If the inner conductors 117 are not implemented integrally with the switch rotor, the inner conductors are mounted in the switch rotor. During the installation the inner conductors 117 are pushed into corresponding recesses in the switch rotor 110 and fixed in place there, for example using screws or other mechanical connections. The dielectric is placed in the recess of the switch rotor in the same way. The dielectric can be held in position by the inner conductor. To this end the dielectric can be adapted to the shape of the inner conductor.

Figure 20:
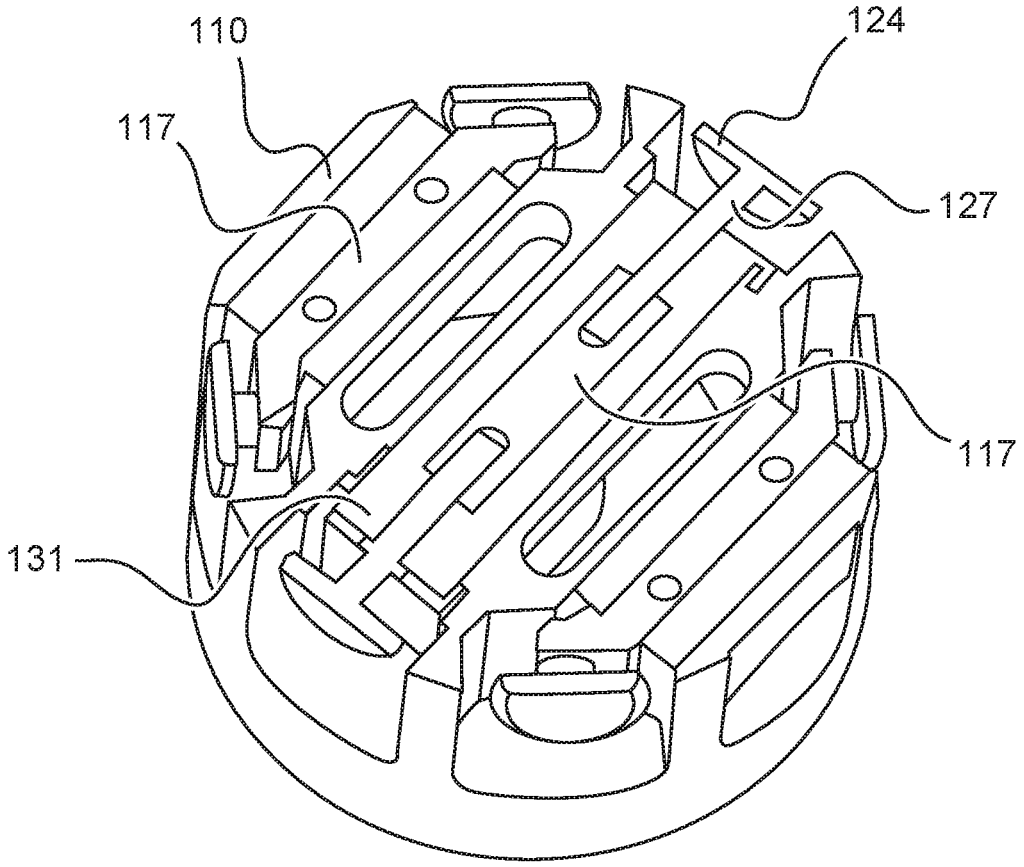
FIG. 20 a schematic sectional view of a switching rotor in accordance with one exemplary embodiment.

FIG. 20 shows a cross-sectional view of a switch rotor 110 with three inner conductors 117, which are designed similar to in FIG. 1C. The inner conductors are connected to the switch rotor on their underside or are designed integrally with the switch rotor. Finally, the inner conductors 117 are surrounded by dielectric 131 in the recess of the switch rotor.

It is also clear from FIG. 20 how the terminating elements 124 are fastened into the inner conductor 117 by means of a connecting piece 127 (e.g. a bolt or a threaded pin). The connecting piece extends into an opening in the inner conductor and is plugged, screwed or otherwise inserted into this opening and fixed therein.

For completeness, it is also noted that "comprising" does not exclude any other elements or steps, and "a" or "an" does not exclude a plurality. It should also be noted that features or steps which have been described with reference to any one of the above examples can also be used in combination with other features or steps of other exemplary embodiments described above.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

LIST OF REFERENCE SYMBOLS

1 switching arrangement
100 switching device
102 housing
104 connector
105 connector
106 connector
107 connector
110 switching rotor
111 longitudinal axis
112 inductive input coupling
114 coaxial post
116 connection
117 inner conductor
118 capacitive coupling
120 capacitive load
122 gap
124 terminating element, plate
125 angle of inclination
126 direction of rotation
127 connecting piece
128 cavity
130 slot
131 insulator, dielectric
135 coaxial connector
140 common capacitive coupling
145 mounting
150 drive

The invention claimed is:

1. A switching arrangement for selectively connecting a plurality of coaxial cables in pairs, the switching arrangement comprising:

a first switching device for connecting a first pair of coaxial cables, the first switching device comprising:

a first housing with at least two coaxial connectors, the at least two coaxial connectors comprising a first coaxial connector and a second coaxial connector;

a first switch rotor arranged in the first housing and configured to be rotated about a first longitudinal axis;

a first electrical connection passing through the first switch rotor and, in a predetermined position of the first switch rotor, configured to capacitively couple the first coaxial connector and the second coaxial connector, thereby creating a first electrical connection between the first coaxial connector and the second coaxial connector;

a second switching device for connecting a second pair of coaxial cables, the second switching device comprising:

a second housing with at least two coaxial connectors, the at least two coaxial connectors comprising a third coaxial connector and a fourth coaxial connector;

a second switch rotor arranged in the second housing and configured to be rotated about a second longitudinal axis;

a second electrical connection passing through the second switch rotor and, in a predetermined position of the second switch rotor, configured to capacitively couple the third coaxial connector and the fourth coaxial connector, thereby creating a second electrical connection between the third coaxial connector and the fourth coaxial connector;

wherein the first switching device is coupled directly to the second switching device by a coaxial connector.

2. The switching arrangement according to claim 1, further comprising, at a coupling point between the first switching device and the second switching device a single coaxial post, so that an electrical connection between the first and second switching devices is made via a capacitive coupling of the respective electrical connections via the single coaxial post, wherein the first housing and second housing are integral to one another.

3. A switching device for connecting coaxial cables, said switching device comprising:

a housing with at least two coaxial connectors, the at least two coaxial connectors comprising a first coaxial connector and a second coaxial connector;

a switch rotor arranged in the housing and configured to be rotated about a longitudinal axis;

a first electrical connection passing through the switch rotor and, in a predetermined position of the switch rotor, configured to capacitively couple the first coaxial connector and the second coaxial connector, thereby creating a first electrical connection between the first coaxial connector and the second coaxial connector, wherein the switch rotor includes a slot, the first electrical connection extending along the slot;

wherein the first electrical connection has an inner conductor, the inner conductor in a first plurality of sections in a longitudinal direction thereof being electrically connected to the switch rotor;

wherein in a second plurality of sections, the inner conductor in the slot is surrounded by an insulator and/or a dielectric, wherein, at each opposite ends thereof in the longitudinal direction of the inner conductor, the first electrical connection has a respective terminating element connected to the inner conductor, wherein each of the respective terminating elements of the first electrical connection is configured to capacitively couple to one of the first coaxial connector and the second coaxial connector each in the predetermined position of the switch rotor and thereby create the first electrical connection between the first coaxial connector and the second coaxial connector, wherein the inner conductor extends between the respective terminating elements of the first electrical connection in a straight line;

wherein each of the respective terminating elements of the first electrical connection is configured in the shape of a plate; and whereby each of the respective terminating elements of the first electrical connection is inclined with respect to the longitudinal direction of the inner conductor.

4. The switching device according to claim 3, further comprising a drive connected to the switch rotor such that the drive is configured to move the switch rotor into different predetermined positions around the longitudinal axis by a rotational movement.

5. The switching device according to claim 3, wherein the inner conductor is electrically connected to the switch rotor over the entire length of at least one side face.

6. The switching device according to claim 3, wherein the inner conductor is configured integrally with the switch rotor or is mechanically coupled to the switch rotor.

7. The switching device according to claim 3, wherein a second electrical connection spaced apart from the first electrical connection extends in the switch rotor.

8. The switching device according to claim 7, wherein the second electrical connection is offset with respect to the first electrical connection in a direction along the longitudinal axis of the switch rotor.

9. The switching device according to claim 7, wherein the second electrical connection extends at an angle between 0° and 90° with respect to the first electrical connection.

10. The switching device according to claim 3, wherein each of the at least two coaxial connectors of the switching device has a respective coaxial post inductively coupled to a corresponding electrical conductor of the respective coaxial connector.

11. The switching device according to claim 10, wherein the first electrical connection is configured to be capacitively coupled to one of the coaxial posts of the respective coaxial connector coupled in the predetermined position of the switch rotor.

12. The switching device according to claim 3, wherein on the switch rotor at least two radial indentations are arranged, within each of which the respective terminating element of the first electrical connection is located.

* * * * *